US009016397B2

(12) United States Patent
Kuroyanagi et al.

(10) Patent No.: US 9,016,397 B2
(45) Date of Patent: Apr. 28, 2015

(54) ELECTRIC POWER TOOL SUSPENDING ATTACHMENT AND ELECTRIC POWER TOOL EQUIPPED WITH THE SAME

(75) Inventors: Takao Kuroyanagi, Anjo (JP); Hidenori Nagasaka, Anjo (JP); Ryunosuke Kumagai, Anjo (JP)

(73) Assignee: Makita Corporation, Anjo-Shi (JP)

( * ) Notice: Subject to any disclaimer, the term of this patent is extended or adjusted under 35 U.S.C. 154(b) by 867 days.

(21) Appl. No.: 13/218,010

(22) Filed: Aug. 25, 2011

(65) Prior Publication Data

US 2012/0085560 A1 Apr. 12, 2012

(30) Foreign Application Priority Data

Oct. 7, 2010 (JP) ..... 2010-227838

(51) Int. Cl.
*B25F 5/02* (2006.01)

(52) U.S. Cl.
CPC ..... *B25F 5/02* (2013.01)

(58) Field of Classification Search
CPC ..... B25F 5/02; B25D 17/04; B25D 17/11; A45F 5/02; A45F 5/021; A45F 2205/026
USPC ..... 173/2, 170, 171; 16/110.1; 224/197, 224/251, 269, 904
See application file for complete search history.

(56) References Cited

U.S. PATENT DOCUMENTS

| | | | | |
|---|---|---|---|---|
| 4,457,462 | A | 7/1984 | Taormina | |
| 2005/0011919 | A1 | 1/2005 | Durham | |
| 2006/0070761 | A1* | 4/2006 | Vahabi-Nejad et al. | 173/217 |
| 2010/0044405 | A1 | 2/2010 | Albert | |
| 2011/0073340 | A1* | 3/2011 | Matsumoto et al. | 173/171 |

FOREIGN PATENT DOCUMENTS

| | | | |
|---|---|---|---|
| JP | 2006239851 A | * | 9/2006 |
| JP | B2-4327115 | | 9/2009 |

OTHER PUBLICATIONS

Nov. 18, 2011 Search Report issued in European Patent Application No. 11181244.2.

* cited by examiner

*Primary Examiner* — Nathaniel Chukwurah
(74) *Attorney, Agent, or Firm* — Oliff PLC

(57) ABSTRACT

A suspending attachment attached to a cylindrical housing of an electric power tool whose output shaft protrudes from a housing distal end includes a ring-shaped distal end portion fitted to the housing distal end, lower retaining portions of which front ends are connected to the distal end portion and extending rearward along a housing lower-half outer surface with a space through which the housing does not radially come off, one upper retaining portion of which a front end is connected to the distal end portion and extending rearward along a housing upper-half outer surface with a space from each lower retaining portion, through which the housing does not come off, a hook portion extending from at least one of rear ends of the lower and upper retaining portions rearward of the housing, and a connecting member coupling the lower and upper retaining portions over a housing rear surface.

13 Claims, 7 Drawing Sheets

ELECTRIC POWER TOOL SUSPENDING ATTACHMENT AND ELECTRIC POWER TOOL EQUIPPED WITH THE SAME

BACKGROUND OF THE INVENTION

This application claims the benefit of Japanese Patent Application Number 2010-227838 filed on Oct. 7, 2010, the entirety of which is incorporated by reference.

TECHNICAL FIELD

The present invention relates to an electric power tool suspending attachment that is attached to a housing of an electric power tool and that is used to suspend the electric power tool, and also relates to an electric power tool equipped with the electric power tool suspending attachment.

BACKGROUND ART

Japanese Patent No. 4327115 describes an electric power tool suspending attachment that may be easily attached to an existing electric power tool. The electric power tool suspending attachment described in Japanese Patent No. 4327115 includes a substantially annular hook portion, a side portion that is provided to extend from the hook portion and a fastening ring (connecting member) that detachably fixes the side portion to a housing of an electric power tool.

The electric power tool suspending attachment described in Japanese Patent No. 4327115 allows the hook portion to hook on the distal end of the housing in a state where the distal end side of the housing is oriented downward, and is attached to an electric power tool by the connecting member in a state where the side portion is substantially in contact with a lateral side of the housing. Furthermore, an opening portion provided at the rear end side of the side portion is attached to a carabiner, or the like, of a worker's belt.

However, with the above described electric power tool suspending attachment, when the connecting member accidentally loosens or breaks and then the connecting member comes off from the housing, the side portion leaves from the lateral side of the housing and is not able to support the housing. As a result, for example, when the distal end portion of the housing is inclined to come off from the hook portion, the electric power tool may drop from the electric power tool suspending attachment.

SUMMARY OF THE INVENTION

The invention provides an electric power tool suspending attachment that effectively prevents a drop of an electric power tool even when a connecting member loosens or breaks and also provides an electric power tool equipped with the electric power tool suspending attachment.

A first aspect of the invention provides an electric power tool suspending attachment that is attached to a cylindrical housing of an electric power tool whose output shaft protrudes from a distal end of the housing extending in a front-rear direction of the electric power tool. The electric power tool suspending attachment includes a ring-shaped distal end portion that is fitted to the distal end of the housing, at least a pair of lower retaining portions of which front ends are connected to the distal end portion and that extend rearward along a lower-half outer surface of the housing with a space through which the housing does not come off in its radial direction, at least one upper retaining portion of which a front end is connected to the distal end portion and that extends rearward along an upper-half outer surface of the housing with a space from each of at least the pair of lower retaining portions, through which the housing does not come off, a hook portion that extends from at least any one of a rear end of one of the lower retaining portions and a rear end of the upper retaining portion to protrude rearward of the housing, and a connecting member that couples the lower retaining portions to the upper retaining portion each other over a rear surface of the housing.

A second aspect of the invention provides such a feature that, in the first aspect, the distal end portion has a coupling portion that may be coupled to a socket fitted to the output shaft coaxially with each other.

A third aspect of the invention provides such a feature that, in the first aspect, at least the lower retaining portions and the hook portion or at least the upper retaining portion and the hook portion are formed of a single wire element.

A fourth aspect of the invention provides an electric power tool whose output shaft protrudes from a distal end of a cylindrical housing extending in a front-rear direction of the electric power tool. The electric power tool includes the electric power tool suspending attachment according to the first aspect or the second aspect that is attached to the housing.

With the electric power tool suspending attachment according to the first aspect of the invention and the electric power tool according to the tenth aspect of the invention, in a state where the hook portion of the electric power tool suspending attachment is hooked to, for example, the carabiner of a worker's belt, or the like, to suspend the electric power tool from the belt, even when the connecting member accidentally loosens or breaks, the housing can be prevented from coming off through the space between the pair of lower retaining portions that extend along the lower-half outer surface of the housing in the radial direction or the space between each lower retaining portion and the upper retaining portion that extends along the upper-half outer surface of the housing. In other words, the electric power tool can be effectively prevented from dropping from the electric power tool suspending attachment. According to the second aspect of the invention, in a state where the socket is coupled to the coupling portion, even when the socket breaks to drop from the output shaft, it is possible to maintain the state where the socket is coupled to the coupling portion. In other words, the socket can be prevented from dropping from the output shaft to the ground. According to the third aspect of the invention, it is not necessary to provide a portion that connects the lower retaining portions or the upper retaining portion to the hook portion while the lower retaining portions or the upper retaining portion are formed separately from the hook portion. Therefore, connecting portions between the retaining portions and the hook portion, which decrease mechanical strength, are not required. Thus, it is possible to enhance the mechanical strength of the electric power tool suspending attachment in which the retaining portions and the hook portion are formed continuously with one another.

DETAILED DESCRIPTION OF THE PREFERRED EMBODIMENTS

Figure 1:
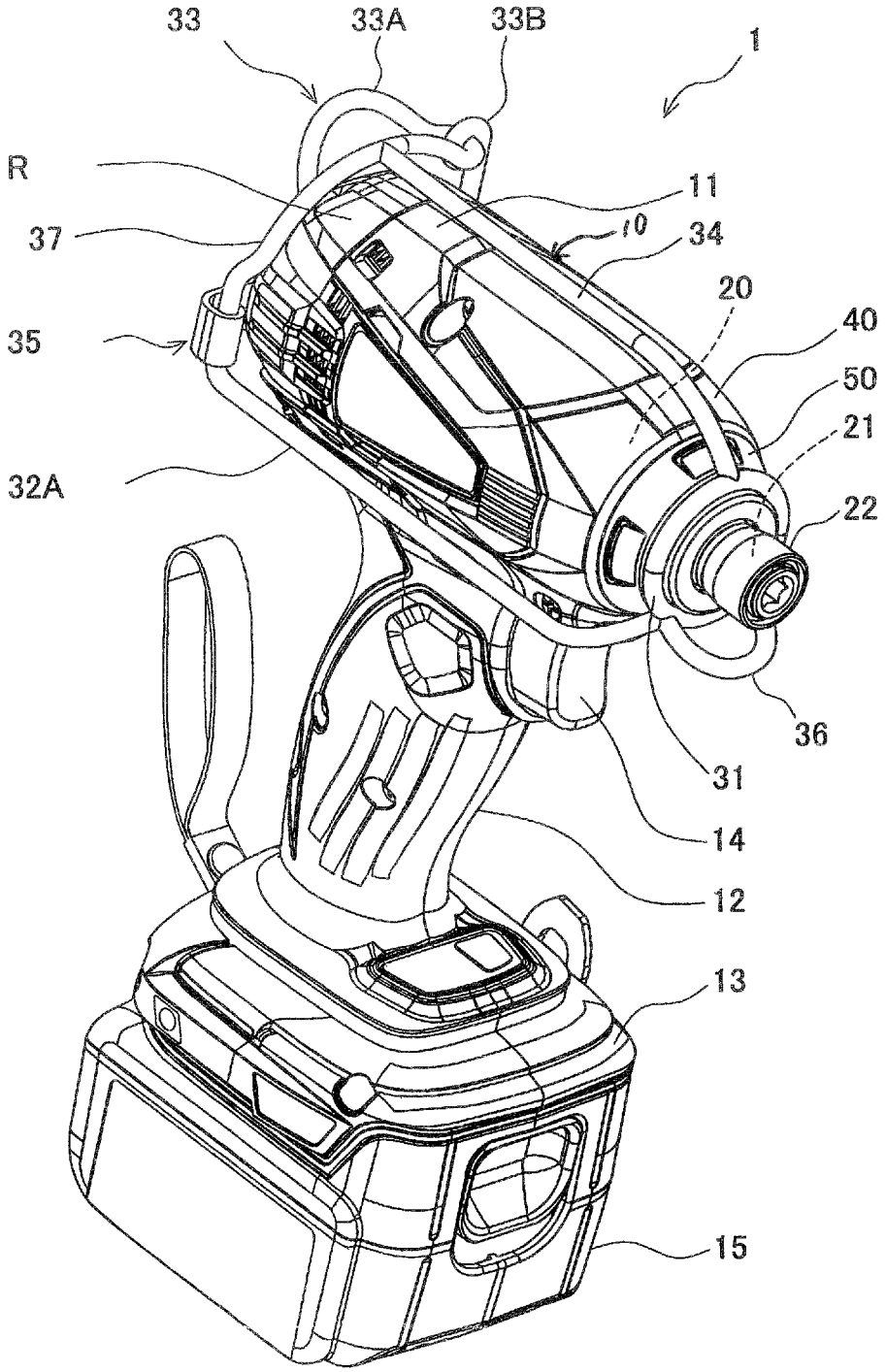
FIG. 1 is a perspective view of an impact driver equipped with an impact driver suspending attachment according to an embodiment of the present invention when viewed from the front side.
Figure 2:
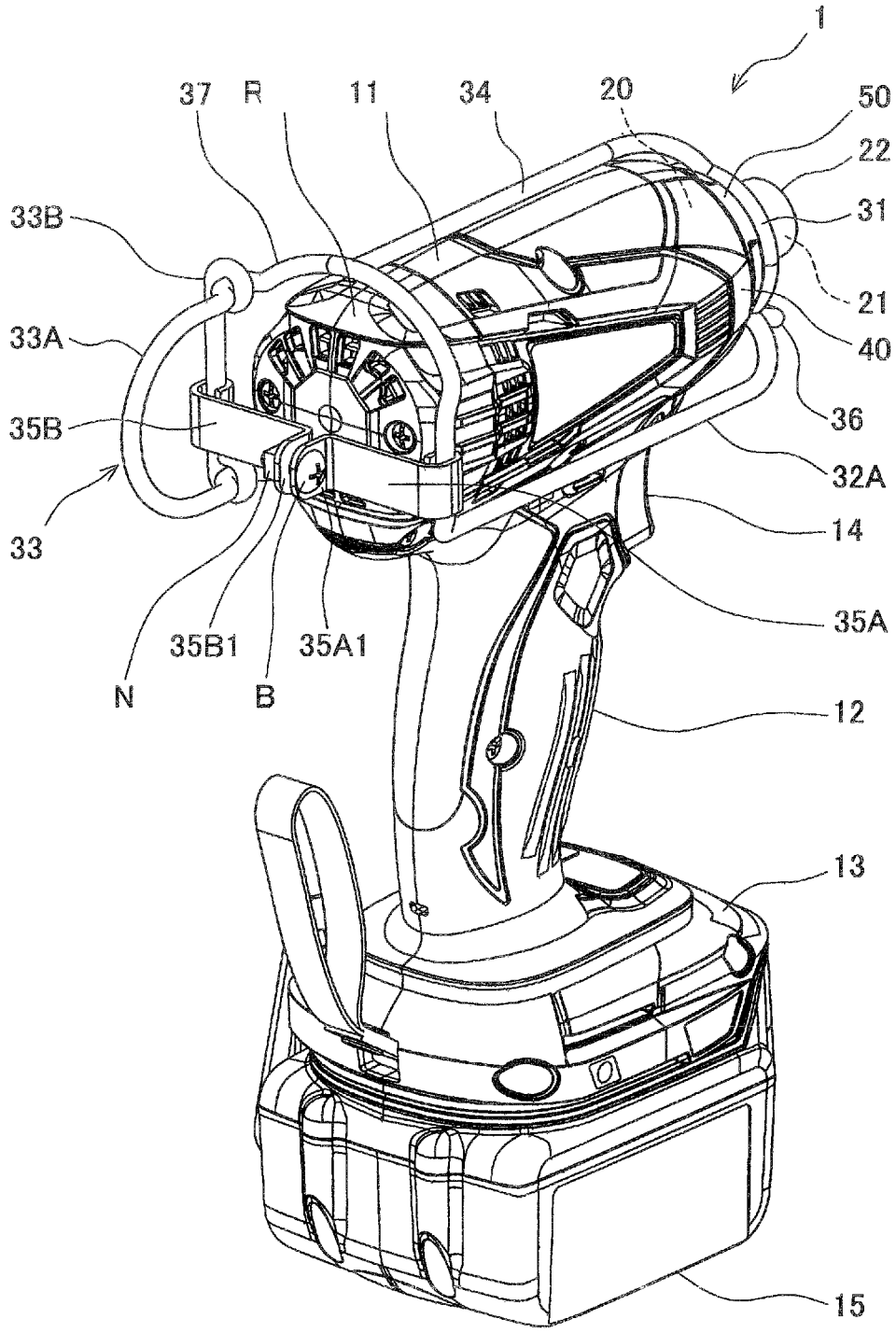
FIG. 2 is a perspective view of the impact driver when viewed from the rear side.

An embodiment of the invention will be described with reference to FIG. 1 to FIG. 7. As shown in FIG. 1 and FIG. 2, an impact driver 1 includes a main housing 10, a striking mechanism 20 and an impact driver suspending attachment 30.

The main housing 10 is formed by assembling right and left half housings made of resin. The main housing 10 has a body portion 11, a rear cover R, a handle portion 12 and a battery pack loading portion 13. The body portion 11 is formed in a substantially cylindrical shape and extends in the front-rear direction (horizontal direction in FIG. 7) of the impact driver 1. The body portion 11 is formed in a tapered shape such that the outside diameter reduces toward the distal end side from which an anvil 21 (described later) protrudes. The body portion 11 accommodates a motor (not shown) inside. The cylindrical rear cover R is fixedly screwed to the rear end portion of the body portion 11. The rear cover R is open at the side adjacent to the body portion 11.

The handle portion 12 is continuously provided from the body portion 11 so as to form a substantially T shape in side view of the impact driver 1. A switch (not shown) having a trigger 14 is accommodated inside the handle portion 12. The battery pack loading portion 13 is provided at the lower end of the handle portion 12. A battery pack 15 that feeds electric power to the motor is detachably loaded at the battery pack loading portion 13.

The striking mechanism 20 is accommodated inside a substantially cylindrical hammer case (not shown) at the distal end side of the body portion 11. A portion of the hammer case, exposed from the body portion 11, is covered with a cover 40 and a bumper 50. Not only the striking mechanism 20 but also the anvil 21 are accommodated inside the hammer case. The anvil 21 protrudes from the distal end of the hammer case. The anvil 21 is rotatably supported inside the hammer case by a bearing. A chuck 22 is provided at the distal end of the anvil 21. A distal end tool (not shown) and a socket 60 (see FIG. 3) may be attached to the chuck 22 coaxially with the anvil 21. The striking mechanism 20 converts rotation of the motor to rotational striking force and then transmits the rotational striking force to the distal end tool and the socket 60. A rotatable protruding member 62 is arranged at a distal end tool insertion portion 61 of the socket 60 separately from the socket 60. A ring member 63 is provided for the protruding member 62. Note that the impact driver 1 is an example of the electric power tool according to the aspect of the present invention, the main housing 10 and the hammer case are an example of the housing according to the aspect of the present invention, and the anvil 21 is an example of the output shaft according to the aspect of the present invention.

Figure 3:
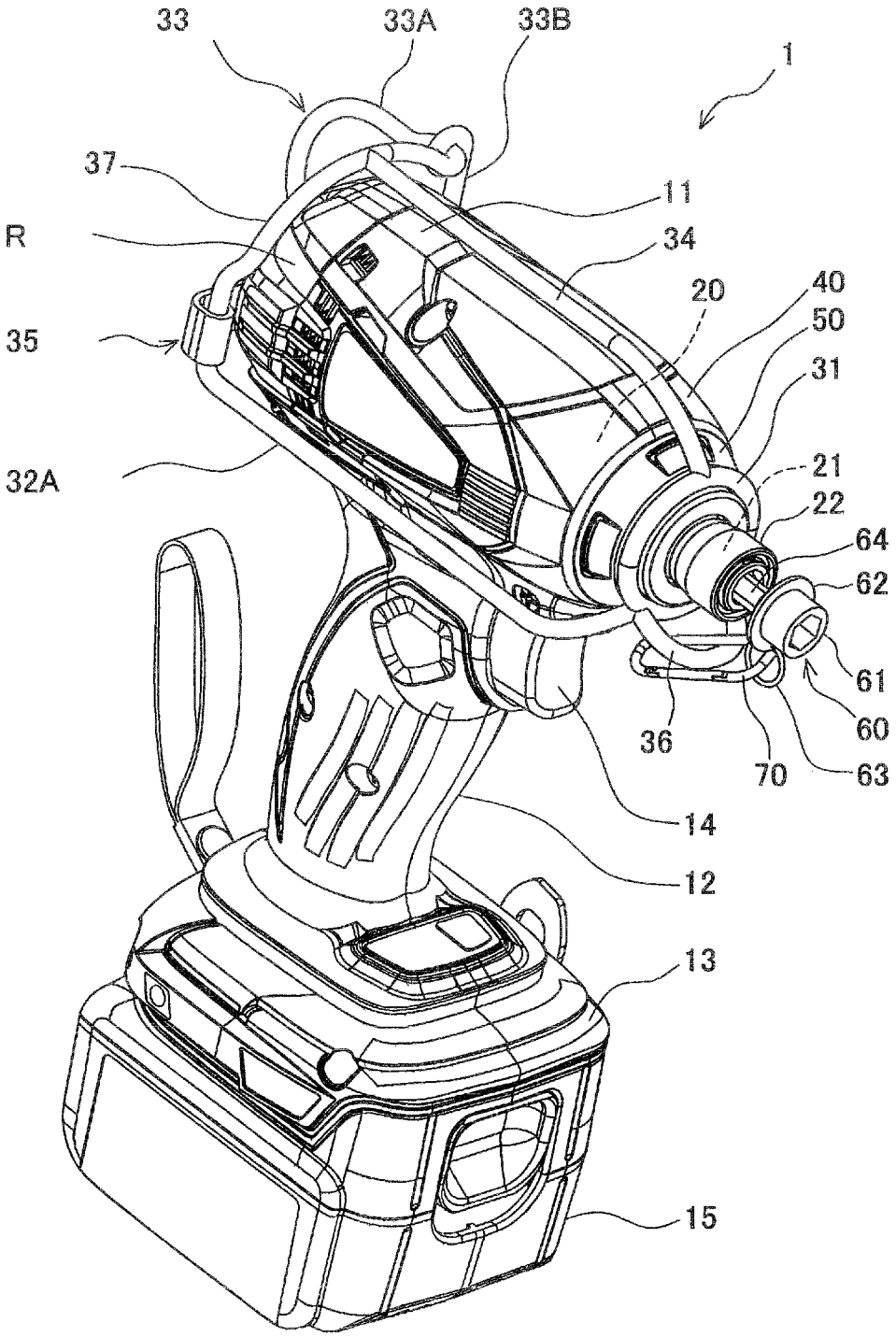
FIG. 3 is a perspective view of the impact driver to which a socket is coupled to a socket coupling portion of the impact driver suspending attachment.
Figure 4:
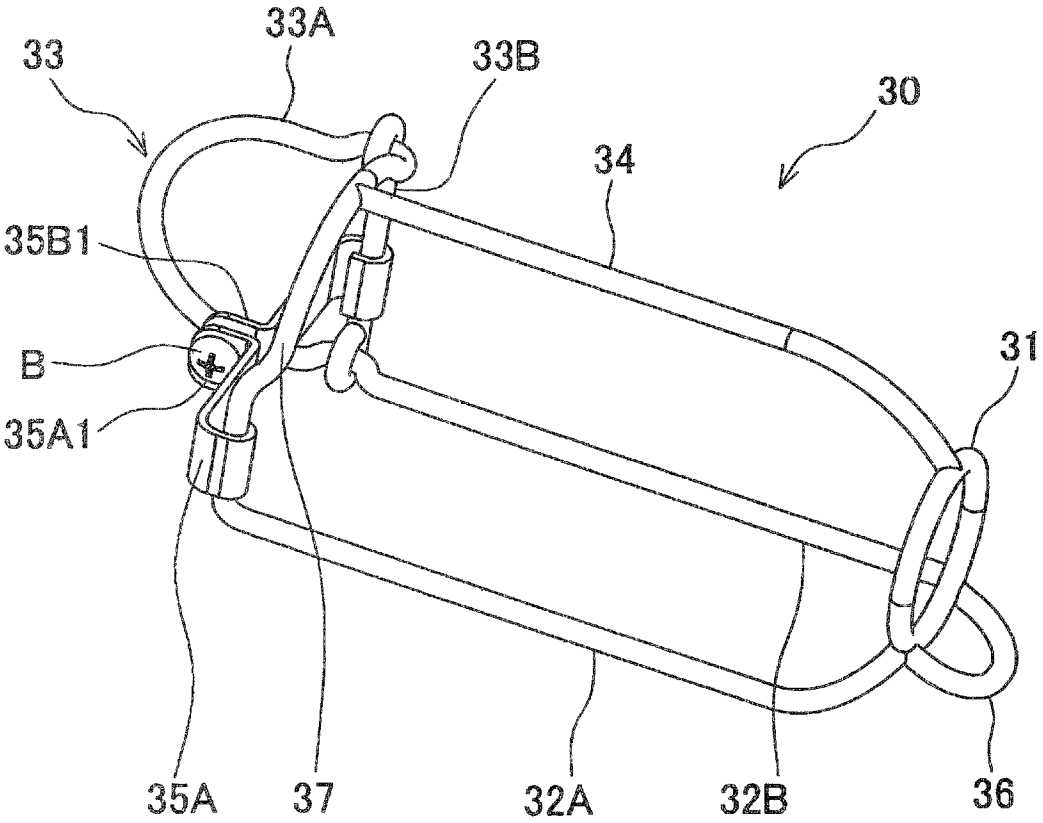
FIG. 4 is a perspective view of the impact driver suspending attachment.

As shown in FIG. 1 and FIG. 4, the impact driver suspending attachment 30 includes a distal end portion 31, lower retaining portions 32A and 32B, a hook portion 33, an upper retaining portion 34, a connecting member 35 and a socket coupling portion 36. FIG. 1 to FIG. 3 and FIG. 5 to FIG. 7 show examples in which the impact driver suspending attachment 30 is attached to the impact driver 1. Note that the impact driver suspending attachment 30 is an example of the electric power tool suspending attachment according to the aspect of the invention.

The distal end portion 31 has a circular ring shape, and is arranged at the distal end side of the impact driver suspending attachment 30. The distal end portion 31 is formed in such a manner that wires are bent and then both end portions of the wires are welded to each other. The distal end portion 31 is fitted around the distal end portion of the hammer case that protrudes from the bumper 50.

Figure 5:
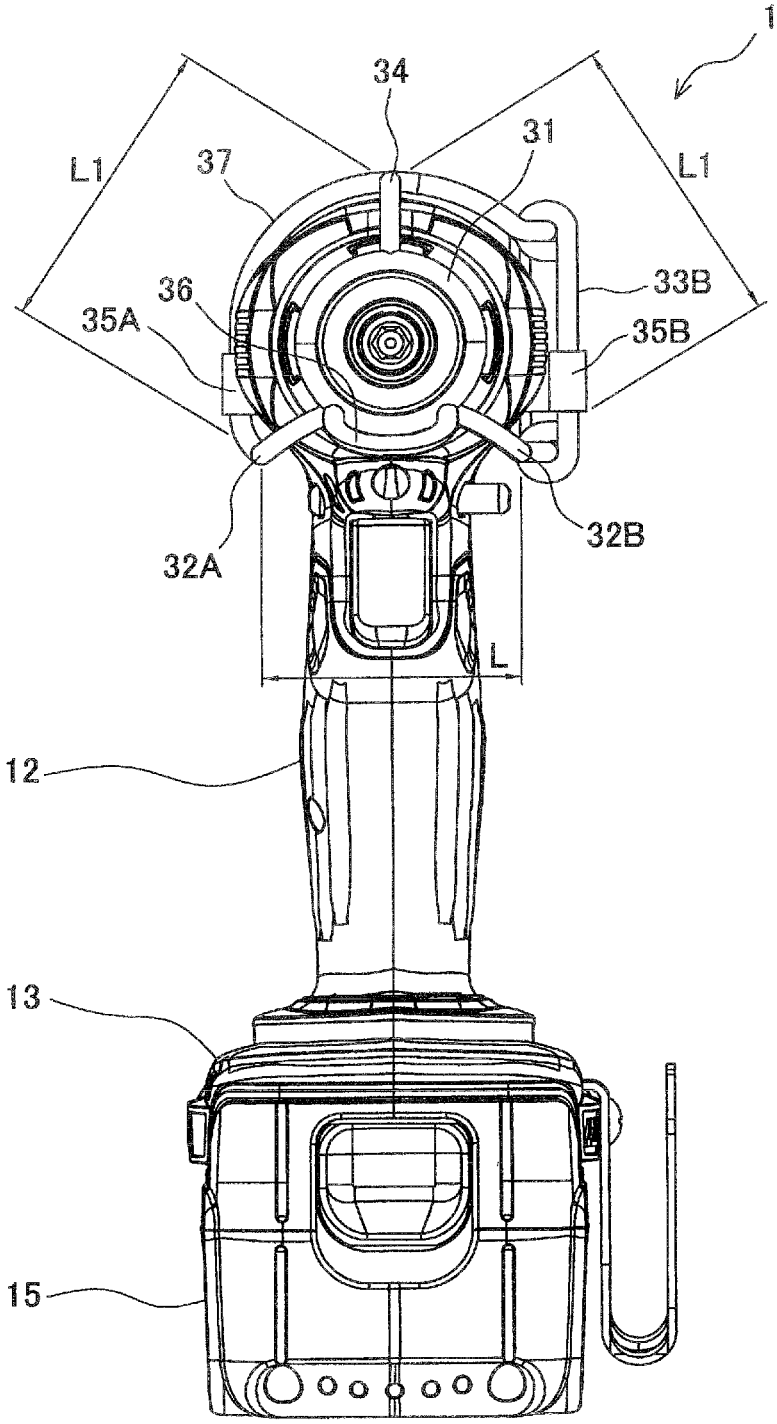
FIG. 5 is a front view of the impact driver equipped with the impact driver suspending attachment.
Figure 6:
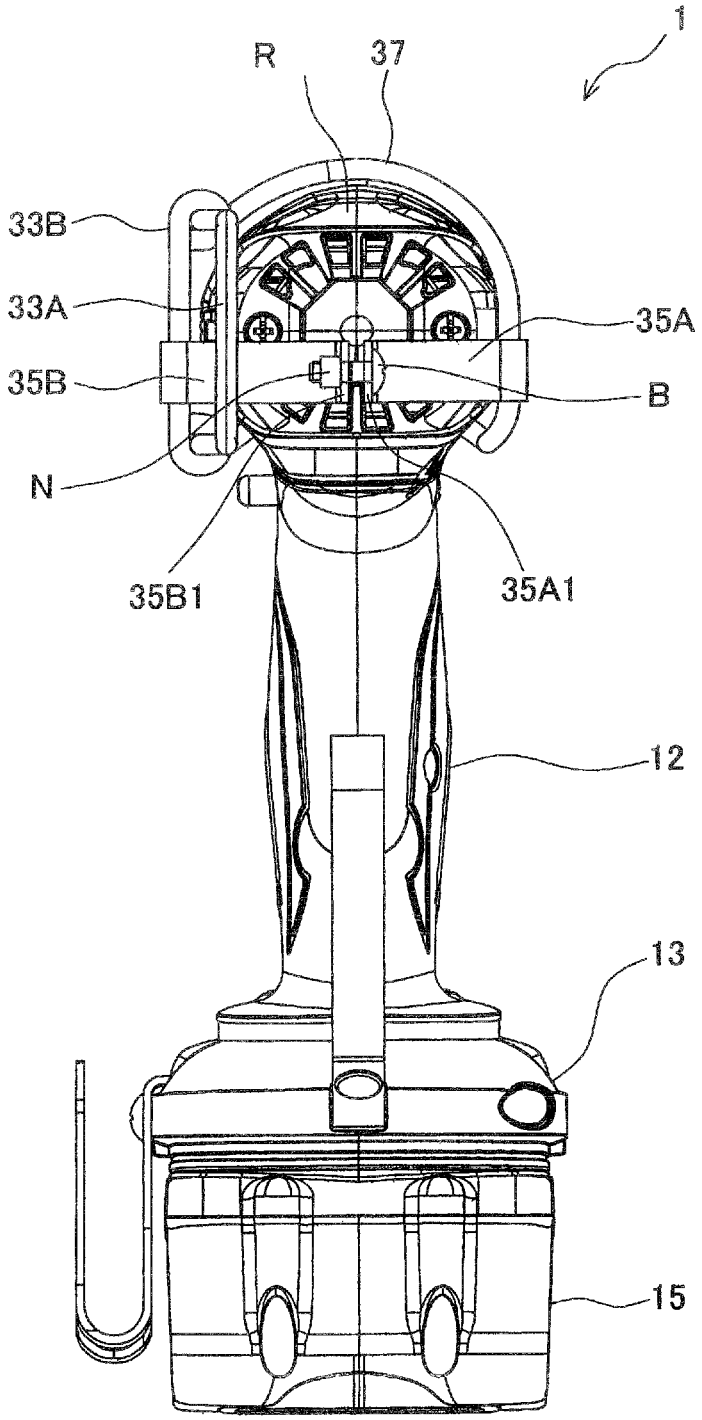
FIG. 6 is a rear view of the impact driver equipped with the impact driver suspending attachment.
Figure 7:
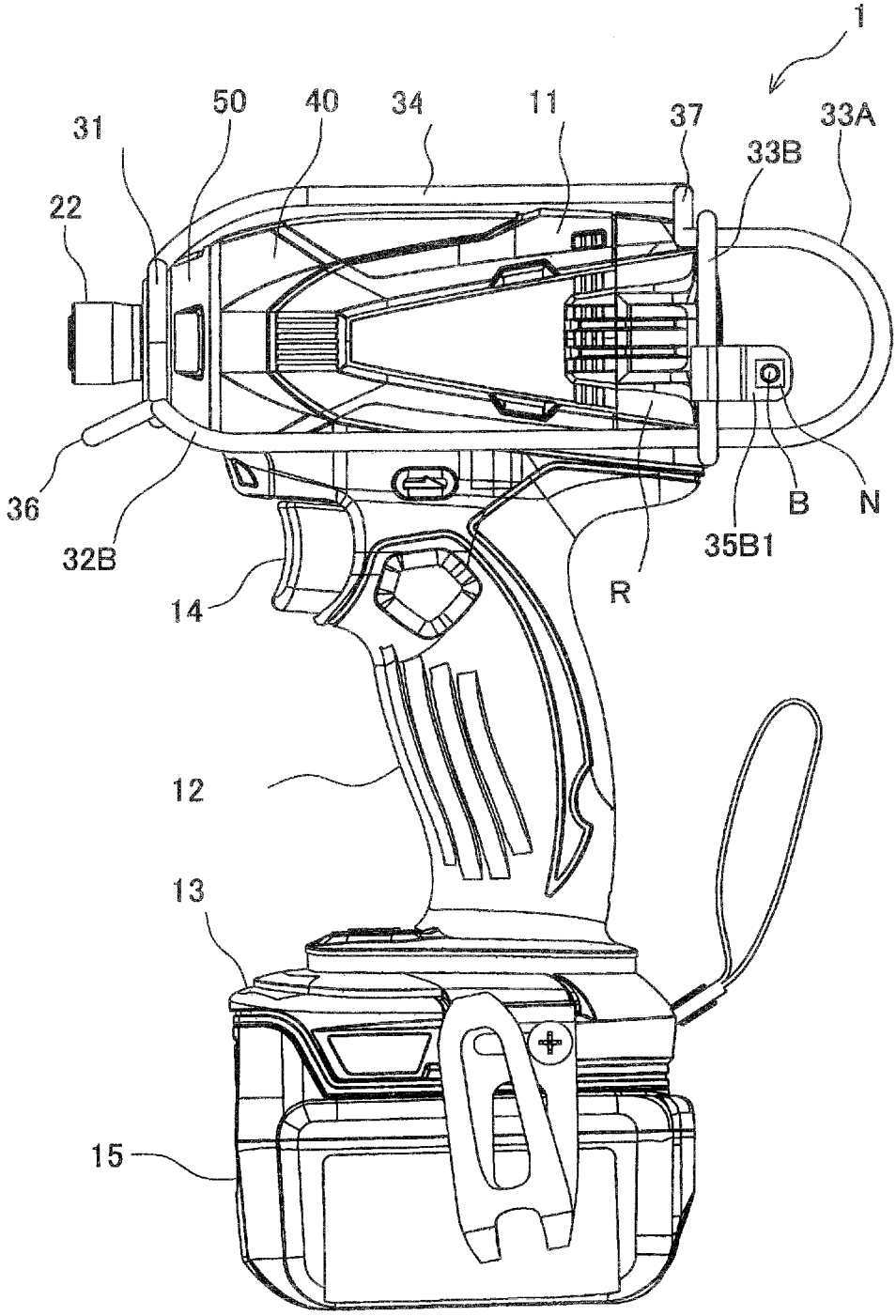
FIG. 7 is a side view of the impact driver equipped with the impact driver suspending attachment.

As shown in FIG. 1 and FIG. 5, the front end of the lower retaining portion 32A is welded at a lower left position on the outer peripheral surface of the distal end portion 31 in front view of the impact driver 1, and the lower retaining portion 32A extends from the welded portion along the lower-half left outer surface of the body portion 11 (hammer case) to the rear side of the body portion 11. On the other hand, as shown in FIG. 5 and FIG. 7, the front end of the lower retaining portion 32B is welded to a lower right position on the outer peripheral surface of the distal end portion 31 in the front view of the impact driver 1, and the lower retaining portion 32B extends from the welded portion, that is, from the lower right portion in the front view of the impact driver 1, along the lower-half right outer surface of the body portion 11 to the rear side of the body portion 11.

The lower retaining portion 32A and the lower retaining portion 32B are arranged with a space L (see FIG. 5) that is smaller than the outer peripheral size of the body portion 11 or the outer peripheral size of the rear cover R. Thus, the body portion 11 and the rear cover R do not radially come off through the space between both the lower retaining portions 32A and 32B. Note that the lower retaining portions 32A and 32B are an example of the pair of lower retaining portions according to the aspect of the invention.

As shown in FIG. 2 and FIG. 4, the hook portion 33 is formed of loopback portion 33A and a bridging portion 33B. One end of the loopback portion 33A is continuous with the lower retaining portion 32A via a bent portion 37, and the other end is continuous with the lower retaining portion 32B. The bent portion 37 is formed so that the bent portion 37 is bent toward the upper side of the rear cover R from the rear end of the lower retaining portion 32A and then extends toward the right side of the rear cover R in front view along the circumferential direction of the rear end surface of the rear cover R. The bent portion 37 is continuous with the loopback portion 33A. Furthermore, as shown in FIG. 7, the loopback portion 33A is formed so that the loopback portion 33A protrudes from the rear end of the lower retaining portion 32B toward the rear side of the rear cover R beyond the rear end surface of the rear cover R and is then looped back toward the rear cover R in a curved shape.

The lower retaining portions 32A and 32B, the loopback portion 33A and the bent portion 37 are formed by bending a single wire. Note that the single wire is an example of the single wire element according to the aspect of the invention.

As shown in FIG. 2, the bridging portion 33B that constitutes the hook portion 33 is formed to extend in the vertical direction of the rear cover R over the loopback portion 33A between one end and the other end of the loopback portion 33A. Both ends of the bridging portion 33B are wound and connected at the respective end portions of the loopback portion 33A. The hook portion 33 has a semi-elliptical ring shape surrounded by the loopback portion 33A and the bridging portion 33B. As will be described later, the hook portion 33 is anchored to a carabiner, or the like, attached to a worker's waist belt.

The upper retaining portion 34 is formed of another single wire separately from the lower retaining portions 32A and 32B, the loopback portion 33A and the bent portion 37. As shown in FIG. 1 and FIG. 5, the front end of the upper retaining portion 34 is welded near the upper center of the outer peripheral surface of the distal end portion 31 in the front view of the impact driver 1.

In addition, the upper retaining portion 34 extends from the welded portion along the upper-half upper outer surface of the body portion 11 (hammer case) to the rear side of the body portion 11, and the rear end of the upper retaining portion 34 is welded to the bent portion 37. The lower retaining portion 32A and the upper retaining portion 34 are arranged with a space L1 (see FIG. 5) in the radial direction of the body portion 11 and the rear cover R. In addition, the lower retaining portion 32B and the upper retaining portion 34 are also arranged with the space L1 in the radial direction. The space L1 is set so as to be smaller than the outer peripheral size of each of the body portion 11 and the rear cover R. Therefore, the body portion 11 and the rear cover R do not radially come off.

The connecting member 35 is used to couple the bent portion 37 to the bridging portion 33B over the rear end surface of the rear cover R. As shown in FIG. 2, the connecting member 35 includes a first connecting fitting 35A and a second connecting fitting 35B. Each of the connecting fittings 35A and 35B is formed of a plate-like iron plate that extends in the right-left direction of the rear cover R. One end of the first connecting fitting 35A is wound around a portion of the bent portion 37, which is bent to extend toward the upper side of the rear cover R. A first protruding piece 35A1 that protrudes toward the rear side of the rear cover R is formed at the other end of the first connecting fitting 35A. The first protruding piece 35A1 has a first screw insertion hole (not shown).

On the other hand, one end of the second connecting fitting 35B is wound around the bridging portion 33B, and a second protruding piece 35B1 that protrudes toward the rear side of the rear cover R and that may be arranged to face the first protruding piece 35A1 is formed at the other end of the second connecting fitting 35B. The second protruding piece 35B1 has a second screw insertion hole (not shown) that faces the first screw insertion hole.

In order to fasten the first protruding piece 35A1 to the second protruding piece 35B1, a screw B is inserted through the first screw insertion hole and the second screw insertion hole and is then screwed to a nut N. By fastening the first protruding piece 35A1 to the second protruding piece 35B1 using the screw B and the nut N, the vertically extended portion of the bent portion 37 is coupled to the bridging portion 33B over the rear end surface of the rear cover R. In this way, the impact driver suspending attachment 30 is attached to the impact driver 1. As a result of coupling the vertically extended portion to the bridging portion 33B, the upper retaining portion 34 welded to the bent portion 37, the lower retaining portion 32A continuously formed with the bent portion 37 and the lower retaining portion 32B continuously formed with the loopback portion 33A may be coupled to one another over the rear end surface of the rear cover R.

As shown in FIG. 3 and FIG. 4, the socket coupling portion 36 protrudes forward and obliquely downward from the lower portion of the distal end portion 31. The socket coupling portion 36 is formed in a substantially U shape by bending a bar (here, wire) and then both ends of the bar are welded to the distal end portion 31. As shown in FIG. 3, a carabiner 70 may be anchored to the socket coupling portion 36 and the ring member 63 so that the carabiner 70 intersects with the socket coupling portion 36 and the ring member 63, The protruding member 62 (ring member 63) is rotatable separately from the socket 60, so the ring member 63 may be coupled to the socket coupling portion 36 using the carabiner 70 without interference with rotation of the socket 60. Note that the socket coupling portion 36 is an example of the coupling portion according to the aspect of the invention.

Next, an example of preventing a drop of the impact driver 1 using the impact driver suspending attachment 30 according to the present embodiment will be described with reference to FIG. 1, FIG. 2 and FIG. 5. Initially, in order to suspend the impact driver 1 from a worker's waist belt, the body portion 11 and the rear cover R are inserted in the space surrounded by the lower retaining portions 32A and 32B and the upper retaining portion 34. Then the outer periphery of the distal end portion of the hammer case is fitted to the distal end portion 31. The first protruding piece 35A1 is fastened to the second protruding piece 35B1 using the screw B and the nut N so that the impact driver suspending attachment 30 is attached to the impact driver 1. After that, the handle portion 12 is gripped with one hand to anchor the ring-shaped portion of the hook portion 33 to the carabiner of the worker's waist belt. Thus, the impact driver 1 may be suspended from the waist belt.

As described above, the spaces L and L 1 are set so that the body portion 11 and the rear cover R do not radially come off through the space between the lower retaining portions 32A and 32B and the space between the lower retaining portion 32A or 32B and the upper retaining portion 34. In addition to this, as shown in FIG. 2, an opening over the rear end surface of the rear cover R is closed by both the fastened protruding pieces 35A1 and 35B1. Thus, the body portion 11 and the rear cover R can be prevented from coming off through the space between the lower retaining portions 32A and 32B, through the space between the lower retaining portion 32A or 32B and the upper retaining portion 34 or from the rear end surface side. Thus, when the impact driver suspending attachment 30 is used, the impact driver 1 may be suspended from a waist belt and may prevent a drop of the impact driver 1.

On the other hand, in a state where the impact driver 1 is suspended from the waist belt, for example, the nut N may accidentally loosen with respect to the screw B to loosen the fastened state between the first protruding piece 35A1 and the second protruding piece 35B1. In addition, one or both of the connecting fittings 35A and 35B may break to open the space over the rear end surface of the rear cover R. In these cases as well, the impact driver 1 can be prevented from dropping from the impact driver suspending attachment 30.

Even when the above described looseness of the fastened state, or the like, occurs, in a state where the distal end portion 31 is fitted to the outer periphery of the distal end portion of the hammer case, the rear cover R and the body portion 11 can be prevented from coming off through the space between the lower retaining portions 32A and 32B or through the space between the lower retaining portion 32A or 32B and the upper retaining portion 34. Thus, the impact driver suspending attachment 30 is able to hold the impact driver 1 being suspended from the waist belt via the hook portion 33 and the carabiner as it is and is able to prevent a drop of the impact driver 1.

In addition, the impact driver suspending attachment 30 is also able to prevent the socket 60 from dropping from the distal end (chuck 22) of the anvil 21 to the ground as will be illustrated below. As shown in FIG. 3, in a state where the carabiner 70 is used to couple the ring member 63 to the socket coupling portion 36, for example, an attachment shaft 64 of the socket 60, attached to the chuck 22, may break and, therefore, a distal end tool insertion portion 61 may drop from the chuck 22. In this case as well, the ring member 63 and the carabiner 70 are used to be able to maintain the state where the distal end tool insertion portion 61 is coupled to the socket coupling portion 36. Thus, the distal end tool insertion portion 61 can be prevented from dropping from the chuck 22 to the ground.

Advantageous Effects of Present Embodiment

With the impact driver suspending attachment 30 and the impact driver 1 equipped with the impact driver suspending attachment 30 according to the present embodiment, the lower retaining portions 32A and 32B are arranged with the space L through which the body portion 11 and the rear cover R do not radially come off. In addition, the upper retaining portion 34 is arranged with the space L1 from each of the pair of lower retaining portions 32A and 32B, through which the body portion 11 and the rear cover R do not radially come off. Therefore, even when the above described fastened state between both protruding pieces 35A1 and 35B1 loosens or the connecting fittings 35A and 35B break in a state where the hook portion 33 is anchored to the carabiner of a worker's waist belt to suspend the impact driver 1 from the waist belt, it is possible to prevent the body portion 11 and the rear cover R from coming off through the space between the lower retaining portions 32A and 32B or through the space between the lower retaining portion 32A or 32B and the upper retaining portion 34. In other words, the impact driver 1 can be effectively prevented from dropping from the impact driver suspending attachment 30.

In addition, when the carabiner 70 is used to couple the ring member 63 of the socket 60 to the socket coupling portion 36, it is possible to maintain the state where the distal end tool insertion portion 61 is coupled to the socket coupling portion 36. Thus, the distal end tool insertion portion 61 can be prevented from dropping from the chuck 22 to the ground.

Furthermore, a single wire is used to form the lower retaining portions 32A and 32B and the loopback portion 33A of the hook portion 33 via the bent portion 37. Therefore, connecting portions between the lower retaining portions 32A and 32B and the loopback portion 33, which decrease mechanical strength, are not required. Thus, it is possible to enhance the mechanical strength of the impact driver suspending attachment 30 in which the lower retaining portions 32A and 32B and the loopback portion 33 are continuous with one another.

The aspect of the invention is not limited to the above described embodiment. The aspect of the invention may be implemented by appropriately modifying part of the configuration without departing from the scope of the invention. In the present embodiment, the pair of lower retaining portions 32A and 32B are respectively formed along the lower-half right and left outer surfaces of the body portion 11 (hammer case), however, the aspect of the invention is not limited to this configuration. Two or more pairs of lower retaining portions may be respectively formed along the right and left outer surfaces.

In addition, in the present embodiment, the single upper retaining portion 34 is formed along the upper-half outer surface of the body portion 11 (hammer case). However, the aspect of the invention is not limited to this configuration. Two or more upper retaining portions may be formed along the upper-half outer surface in such a manner that the two or more upper retaining portions ensure a space from each of the lower retaining portions 32A and 32B, through which the body portion 11 and the rear cover R do not radially come off.

Furthermore, different from the above described embodiment, a single wire may be bent to form the hook portion 33 continuously at the rear end of the upper retaining portion 34 so as to protrude from the rear end surface of the rear cover R toward the rear side of the rear cover R. In this case, it is applicable that a pair of lower retaining portions are formed of another wire different from the single wire without providing the bent portion 37 and then the upper retaining portion 34 is coupled to the pair of lower retaining portions and the pair of lower retaining portions are coupled to each other by a connecting fitting, or the like.

In addition, different from the above described embodiment, for example, a hook portion may be continuously formed between the rear end of the lower retaining portion 32B and the rear end of the upper retaining portion 34 so as to protrude from the rear end surface of the rear cover R toward the rear side of the rear cover R.

Furthermore, different from the above described embodiment, a band-like metal plate, or the like, may be bent instead of a wire to continuously form the lower retaining portions 32A and 32B, the loopback portion 33A and the bent portion 37. In addition, the aspect of the invention may be applied to not only the above described chargeable impact driver 1 but also an electric power tool, such as a chargeable hammer drill and an alternating-current driven impact driver.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An electric power tool suspending attachment that is attached to a cylindrical housing of an electric power tool whose output shaft protrudes from a distal end of the housing extending in a front-rear direction of the electric power tool, comprising:

a ring-shaped distal end portion that is fitted to the distal end of the housing;

a pair of lower retaining portions of which front ends are connected to the distal end portion and that extend rearward along a lower-half outer surface of the housing with a first space, the first space being dimensioned such that the housing does not come off from the first space;

an upper retaining portion of which a front end is connected to the distal end portion and that extends rearward along an upper-half outer surface of the housing, the upper retaining portion being spaced apart from each of the pair of lower retaining portions with a second space, the second space being dimensioned such that the housing does not come off from the second space;

a hook portion that extends from at least any one of a rear end of one of the lower retaining portions and a rear end of the upper retaining portion to protrude rearward of the housing; and a connecting member that couples the lower retaining portions to the upper retaining portion each other at a rear of a proximal end of the housing, the connecting member extending in a direction substantially perpendicular to the front-rear direction of the electric power tool such that the connecting member prevents the housing from coming off rearward.

2. The electric power tool suspending attachment according to claim 1, wherein the distal end portion has a coupling portion that may be coupled to a socket fitted to the output shaft coaxially with each other.

3. The electric power tool suspending attachment according to claim 2, wherein at least the lower retaining portions and the hook portion or at least the upper retaining portion and the hook portion are formed of a single wire element.

4. The electric power tool suspending attachment according to claim 2, wherein a rotatable ring member that is formed separately from the socket is provided to project from the socket and then an anchor member that is anchored to the coupling portion and the ring member to allow the socket to be coupled to the coupling portion.

5. The electric power tool suspending attachment according to claim 2, wherein the coupling portion has a substantially U shape.

6. The electric power tool suspending attachment according to claim 2, wherein the coupling portion has a substantially U shape.

7. The electric power tool suspending attachment according to claim 1, wherein at least the lower retaining portions and the hook portion or at least the upper retaining portion and the hook portion are formed of a single element.

8. The electric power tool suspending attachment according to claim 7, wherein the lower retaining portions and the hook portion are formed of the single element.

9. The electric power tool suspending attachment according to claim 8, wherein the single element is a wire.

10. The electric power tool suspending attachment according to claim 1, wherein the connecting member has a plate-like shape, and includes a connecting fitting that couples the pair of lower retaining portions so as to close a space over the rear surface.

11. The electric power tool suspending attachment according to claim 1, wherein the hook portion has a semi-elliptical shape.

12. An electric power tool whose output shaft protrudes from a distal end of a cylindrical housing extending in a front-rear direction of the electric power tool, comprising:

an electric power tool suspending attachment that is attached to the housing, wherein the electric power tool suspending attachment comprises:

a ring-shaped distal end portion that is fitted to the distal end of the housing;

a pair of lower retaining portions of which front ends are connected to the distal end portion and that extend rearward along a lower-half outer surface of the housing with a first space, the first space being dimensioned such that the housing does not come off from the first space:

an upper retaining portion of which a front end is connected to the distal end portion and that extends rearward along an upper-half outer surface of the housing, the upper retaining portion being spaced apart from each of the pair of lower retaining portions with a second space, the second space being dimensioned such that the housing does not come off from the second space:

a hook portion that extends from at least any one of a rear end of one of the lower retaining portions and a rear end of the upper retaining portion to protrude rearward of the housing: and a connecting member that couples the lower retaining portions to the upper retaining portion each other at a rear of a proximal end of the housing, the connecting member extending in a direction substantially perpendicular to the front-rear direction of the electric power tool such that the connecting member prevents the housing from coming off rearward.

13. An electric power tool whose output shaft protrudes from a distal end of a cylindrical housing extending in a front-rear direction of the electric power tool, comprising:

an electric power tool suspending attachment that is attached to the housing, wherein the electric power tool suspending attachment comprises:

a ring-shaped distal end portion that is fitted to the distal end of the housing;

a pair of lower retaining portions of which front ends are connected to the distal end portion and that extend rearward along a lower-half outer surface of the housing with a first space, the first space being dimensioned such that the housing does not come off from the first space;

an upper retaining portion of which a front end is connected to the distal end portion and that extends rearward alona, an upper-half outer surface of the housing, the upper retaining portion being spaced apart from each of thepair of lower retaining portions with a second space, the second space being dimensioned such that the housing does not come off from the second space;

a hook portion that extends from at least any one of a rear end of one of the lower retaining portions and a rear end of the upper retaining portion to protrude rearward of the housing; and a connecting member that couples the lower retaining portions to the upper retaining portion each other at a rear of a proximal end of the housing, the connecting member extending in a direction substantially perpendicular to the front-rear direction of the electric power tool such that the connecting member prevents the housing from coming off rearward, wherein the distal end portion has a coupling portion that may be coupled to a socket fitted to the output shaft coaxially with each other.

* * * * *